United States Patent [19]

Crist

[11] Patent Number: 5,062,646

[45] Date of Patent: Nov. 5, 1991

[54] VOLLEYBALL TRAINING APPARATUS

[76] Inventor: Michael A. Crist, Rte. 2 Box 82, Ewing, Mo. 63440-9424

[21] Appl. No.: 637,276

[22] Filed: Jan. 3, 1991

[51] Int. Cl.[5] ..... A63B 69/00

[52] U.S. Cl. ..... 273/411; 273/29 A; 273/394

[58] Field of Search ..... 273/411, 26 R, 29 A, 273/394, 396, 397

[56] References Cited

U.S. PATENT DOCUMENTS

| | | | |
|---|---|---|---|
| 1,371,867 | 3/1921 | Dean | 273/397 |
| 3,215,432 | 11/1965 | Lee et al. | 273/29 A |
| 3,563,544 | 2/1971 | Hedrick | 273/29 A |
| 3,825,259 | 7/1974 | Burchett | 273/29 A |
| 3,918,711 | 11/1975 | Zak | 273/26 A X |
| 4,153,246 | 5/1979 | Byrne | 273/29 A X |
| 4,291,885 | 9/1981 | Cohen | 273/397 X |
| 4,592,547 | 6/1986 | Thaxton | 273/394 X |
| 4,830,382 | 5/1989 | Wheeler | 273/411 |
| 4,968,042 | 11/1990 | Stewart | 273/411 |

*Primary Examiner*—William H. Grieb

*Attorney, Agent, or Firm*—Joseph W. Holloway

[57] ABSTRACT

A pair of spaced, wall-mounted frames support an abbreviated volleyball net and a no-rebound ball barrier which catches and returns a ball struck over the net. The frames are pivotably mounted and may be folded toward one another whereby the net and ball barrier collapse downwardly. A protective screen may then be drawn upwardly over the net, the ball barrier and a greater portion of the folded frames. The frames include vertically movable members to which the net is attached; and, these members may be adjusted to vary the net height as desired.

19 Claims, 3 Drawing Sheets

VOLLEYBALL TRAINING APPARATUS

BACKGROUND OF THE INVENTION

This invention relates to training apparatus for developing specific athletic abilities and court skills of volleyball players.

All members of a volleyball team must be able to perform several essential ball-striking tasks such as serving, passing, setting and spiking. While most players acquire rudimentary abilities through their participation in routine team practices and competitive game play, repetitive drills are generally employed by teachers and coaches to maximize each player's proficiency. Likewise, individual players may be highly drilled in a given task in order that they may become exceptionally adept in some specific aspect of game play such as setting or spiking the ball. Usually only a limited amount of space suitable for volleyball practice is available in a typical gymnasium and this same space must be shared with other sports activities; therefore, disposable court space and time will be devoted, in the main, to full team practice in order that the greatest possible number of players may benefit. Such lack of court time beyond team practice needs reduces or eliminates opportunities for teaching and drilling individual players for the purposes stated above.

Should, however, court time be available for use by a trainee selected for individual coaching and drill, a significant amount of this time is unfortunately lost in retrieving practice balls which become scattered about the court area. Either the practice session must be periodically interrupted to recover balls, or one or more persons must chase down and return balls as they are struck by the trainee. Thus ball retrieval is an interruptive, inefficient and annoying aspect of a practice exercise which takes place on but one side of the net.

Off-court drills which involve striking the ball against a wall surface to approximate serving or spiking, for example, are impractical in several respects. The player does not practice ball-handling technics under court conditions consistant with those encountered during actual game play; ball retrieval creates the troublesome interruptions cited above; and, there is a risk that a player's momentum may cause him to collide with the wall surface or that he may be injured by a sharply rebounding ball.

One commercially available training apparatus limited to developing ball spiking skill comprises an upright standard which may be positioned next to the net and has laterally extending arms near its upper end which releasably hold a ball therebetween somewhat above the upper edge of the net. A player may practice his spiking technic by jumping upwardly and driving the ball over the net from between the ball-holding arms. This apparatus exhibits several shortcomings; namely, the ball is held by the arms in an unrealistic, stationary manner; each time a ball is spiked the apparatus must be reloaded and the spiked ball must be retrieved; and, there exists a risk of injury to the player should he strike some portion of the standard with his arm or body. Moreover, such ancillary equipment must be transported to the court and set up each time it is used and storage of such sizable and awkward devices between uses may create a space problem.

SUMMARY OF THE INVENTION

It is a general object of this invention to provide a volleyball training apparatus which creates practice conditions remarkably similar to game play without the need for an actual volleyball court. To this end, a laterally abbreviated net is supported at regulation height above a floor surface between a pair of spaced standoff frames projecting only a short distance from a vertical surface which may conveniently comprise any interior wall of a gymnasium. An especially advantageous feature of this training apparatus is the provision of a flexible, no-rebound ball barrier carried by the aforementioned frames and interposed between the net and the gymnasium wall. This barrier catches and automatically returns balls hit over the net to a suitable ball storage container. Since the preferred width of the hereindisclosed net is about one half that of a regulation net and since the ball barrier prevents troublesome scattering of practice balls, the floor space which must be dedicated to the utilization of this training apparatus comprises a very small portion of the total area of a regulation size volleyball court. Such conservation of floor area permits simultaneous use of one or more of the subject apparatus about the perimeter of a court upon which full team practice may also take place.

Another object of the invention is realized through the provision of a pair of wall-mounted standoff frames for supporting the net and the aforementioned ball barrier. These frames are pivotally secured to the wall and are swingable toward one another whereby the entire apparatus may be folded closely against the wall for compact storage when not in use. A related object is the provision of a protective screen for the stored apparatus which substantially shields the folded apparatus thereby protecting the same from damage and unwanted tampering. To this end, a flexible sheet of protective material depends below the standoff frames when the apparatus is in use; and, this sheet may be drawn upwardly to overlie a substantial portion of the front of the apparatus when the latter is folded for storage.

These and other advantages and more detailed objects of this invention and the manner of obtaining them will become apparent and the invention will be best appreciated and fully understood by having reference to the following detailed description of the disclosed embodiment of the invention taken in conjunction with the accompanying drawings.

DETAILED DESCRIPTION OF THE INVENTION

Figure 1:
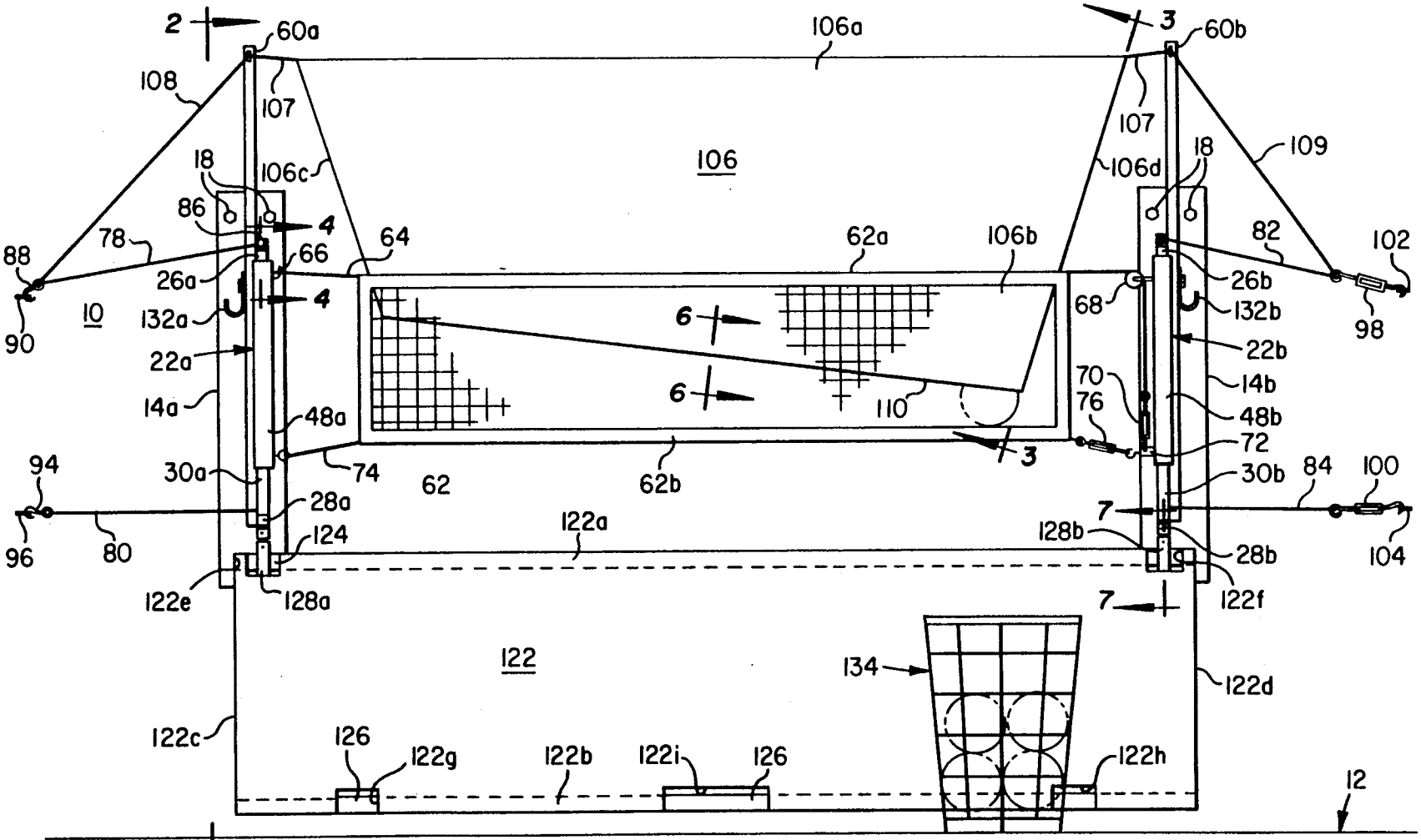
FIG. 1 is a front elevation illustrating a training apparatus according to this invention rigged and ready for use.
Figure 2:
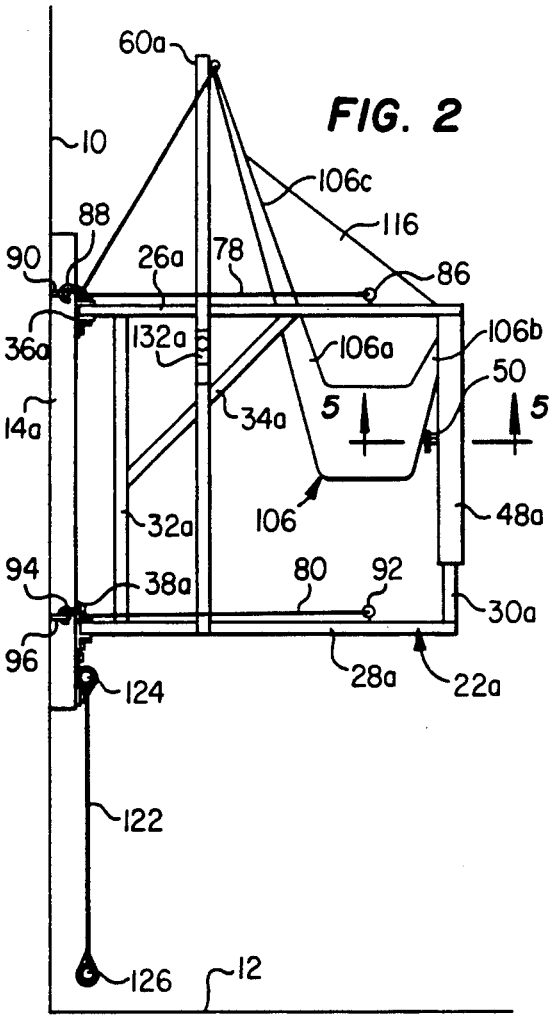
FIG. 2 is a side elevation looking along lines 2—2 of FIG. 1.

FIGS. 1 and 2 illustrate the preferred means by which a volleyball training apparatus according to this invention may be mounted with respect to an upright wall surface 10 and an intersecting floor surface 12. A pair of vertically elongated, horizontally spaced mounting bases 14a and 14b are firmly attached to the wall surface 10 by suitable means such as threaded fasteners 18 penetrating the upper and lower ends of the mounting bases.

A pair of horizontally spaced standoff frames 22*a* and 22*b* are pivotably attached to the bases 14*a* and 14*b*, respectively. These rigid frames are generally rectangular in shape and are identically constructed of suitable tubular plastic or metal members assembled in a well known manner by fasteners, adhesive material or welding. Referring to frame 22*a*, shown in FIG. 2, the upper and lower horizontal members 26*a* and 28*a* are spaced by vertical members 30*a* and 32*a*. Member 30*a* is in registration with the distal ends of members 26*a* and 28*a* and, member 32*a* is attached a short distance from the free ends of members 26*a* and 28*a* which are proximate the mounting base 14*a*. An angularly disposed strengthening brace 34*a* extends between frame members 32*a* and 26*a*.

Figure 4:
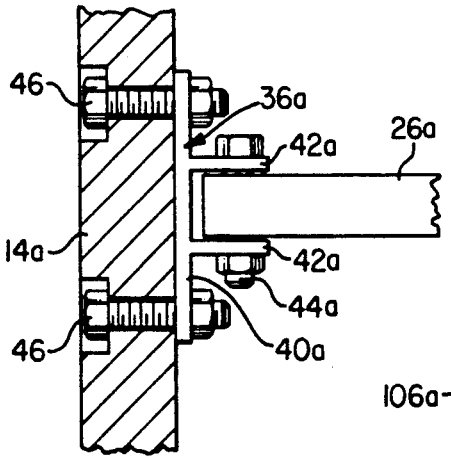
FIG. 4 is a sectional view taken generally along lines 4—4 of FIG. 1.

FIG. 4 shows that the frame members 26*a* and 28*a* are attached to base member 14*a* by means of like brackets 36*a* and 38*a*. Each bracket includes a base, such as that indicated by numeral 40*a*, having projecting clevis arms 42*a* penetrated by a suitable clevis pin 44*a* which may comprise a threaded fastener or the like. The brackets are secured to their respective bases b14*a* or 14*b* by fasteners 46 in the manner shown in FIG. 4. The function of the brackets 36*a* and 38*a* and like brackets, not shown, secured to base 14*b* is to provide free-swinging, pivotal movement of the standoff frames 22*a* and 22*b* with respect to the wall 10. To this end, the projecting free ends of frame members 26*a* and 28*a* are pivotably secured between the clevis arms.

Figure 5:
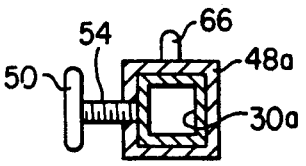
FIG. 5 is a sectional view taken along lines 5—5 of FIG. 2.

Disposed in vertically telescoping relation to the upright frame members 30*a* and 30*b* are elongated, tubular members 48*a* and 48*b*. The members 48*a* and 48*b* surround members 30*a* and 30*b* and have a similar cross sectional configuration which, in the depicted embodiment, is square. The telescoping members 48*a* and 48*b* may be releasably locked in a selected vertical position between the upper and lower horizontal frame members 26*a*, 28*a* and 26*b*, 28*b* by means of adjusting knobs 50, one of which is shown in FIGS. 2 and 5. In the condition depicted in FIGS. 2 and 5, the extreme upper end surface of member 48*a* abutts frame member 26*a*. The knob 50 has an enlarged cylindrical head 52 for rotating a threaded stem 54 into or out of locking engagement with vertical frame member 30*a*.

Rigidly attached to and supported by each frame 22*a* and 22*b* are a pair of like vertical masts 60*a* and 60*b* which project vertically upwardly a substantial distance above frame members 26*a* and 26*b*, respectively. As viewed in FIG. 1, these masts are attached to the outboard sides of frame members 26*a* and 28*a* on the left-hand side of the apparatus and to the outboard sides of frame members 26*b* and 28*b* on the right-hand side of the apparatus.

As previously noted, an important aspect of this invention resides in conservation of floor space available for volleyball practice activities. In furtherance of this object, the net 62 shown in FIG. 1 is substantially reduced in side-to-side dimension, i.e. in width, from that of a regulation volleyball net. Preferrably, the width of net 62 is less than one half the width of a regulation net whereby the side-to-side dimension of the floor space located directly in front of the net is greatly reduced while yet affording adequate net width for a variety of realistic ball-striking drills to be described hereinafter.

The net is supported between the aforedescribed standoff frames 22*a*, 22*b* by means of a taut horizontal line 64 which is attached to the upper marginal edge 62*a* of the net by any well-known means. As viewed in FIG. 1, the left-hand end of line 64 is secured to a hook 66 or similar means attached to the inboard surface of the telescoping tubular member 48*a*; and, the right-hand end of line 64 is reeved downwardly through a pully 68 for attachment to a line-tensioning device, such as the depicted turnbuckle 70, which is, in turn, attached to a lug 72 projecting from the inboard surface of member 48*b*. The lower edge 62*b* of the net 62 is drawn downwardly by a bottom net line 74 and an attached line tensioning device 76 which are respectively secured to member 48*a* and to the lug 72.

When the apparatus is set up for its intended use in the manner illustrated in FIGS. 1 and 2, the standoff frames 22*a* 22*b* are generally perpendicular with respect to the wall 10 whereby the net 62 is spaced from the wall 10 to the greatest possible extent. The frames 22*a*, 22*b* are tensioned in this extended position relative to the wall by the counteraction of the net lines 64, 74 and turnbuckle 76 against guys 78, 80, 82 and 84. As best seen in FIG. 2, guy 78 extends between an eyebolt 86 on the upper horizontal frame member 26*a* and an attached hook 88 which releasably engages with an eyebolt 90 secured to wall 10. Guy 80 is similarly attached between member 28*a* and wall 10 by means of eyebolt 92, hook 94 and fastener 96. Guys 82 and 84 are attached at one end to members 26*b* and 28*b* and have their other ends attached to the eye portions of turnbuckles 98 and 100, respectively, the latter having hook ends releasably secured to eyebolts 102 and 104 anchored in wall 10.

An important feature of the disclosed volleyball training apparatus is the provision of means to eliminate indiscriminate scattering of balls about the practice area. To this end, a ball barrier, indicated in its entirety by numeral 106, is disposed rearwardly of the net 62 between the net and the wall 10. The barrier may be made of any suitably strong, light weight and flexible material such as canvas, plastic sheeting or netting, forexample. The barrier 106 has the configuration seen in FIGS. 1 and 3 and includes a rear wall 106*a* which is supported by line 107 extending between masts 60*a* and 60*b*, and a front wall 106*b* secured along the top edge 62*a* of the net 62. Guys 108 and 109 extend from points of attachment adjacent the tops of masts 60*a* and 60*b*, respectively, downwardly and outwardly and are attached to the hook 88 and to the turnbuckle 98, respectively, as best illustrated in FIG. 1.

Figure 3:
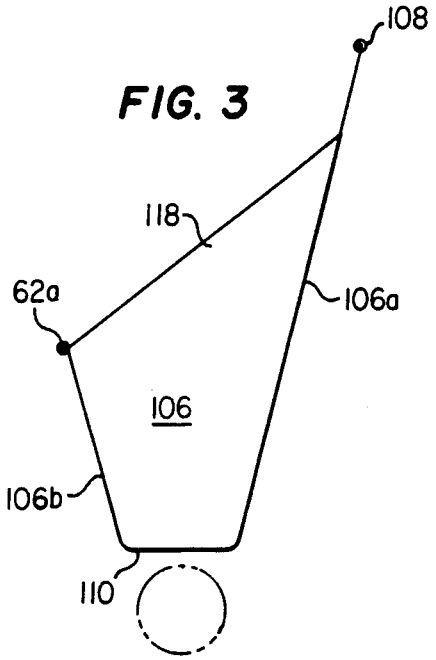
FIG. 3 is a side view of the ball barrier looking along lines 3—3 of FIG. 1.
Figure 6:
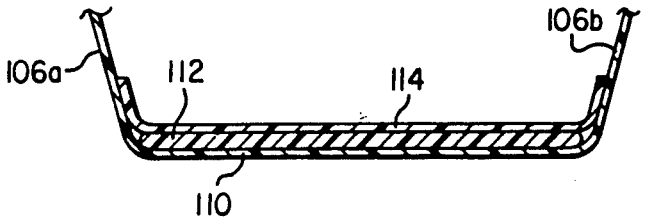
FIG. 6 is a fragmentary section taken along lines 6—6 of FIG. 1.
Figure 7:
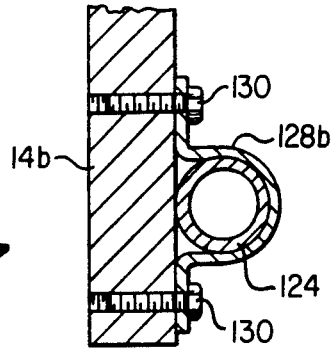
FIG. 7 is a sectional view taken generally along lines 7—7 of FIG. 1.

The left-hand edge 106*c* of the ball barrier and its right-hand edge 106*d* are sufficiently long to permit the bottom 110 of the barrier to depend below the upper edge 62*a* of the net. The bottom 110 of barrier 106 slopes downwardly from left to right, as viewed in FIG. 1, because the length of edge 106*c* is made less than the length of edge 106*d*. Preferrably, the bottom 110 of the barrier 106, shown in cross section in FIG. 6, is overlain by a stiffening member 112 which extends the full width of the barrier 106. The stiffener 112 may comprise an elongated rectangular member, about as wide as the diameter of a volleyball, which is sandwiched between the barrier bottom 110 and a covering sheet 114 attached to the stiffener and to the barrier walls 106*a* and 106*b* by adhesive or by stitching. The generally U-shaped ends of the barrier 106 are at least partially closed by end closure members 116 and 118 which are made of flexible sheet material and may be attached to barrier edges 106*c* and 106*d*, respectively, by an adhesive or by stitching. Near the extreme right-hand side of the bottom wall 110 is an opening, not shown, sized to permit a volleyball to pass therethrough, as shown in FIG. 3. Alternatively, the ball opening may be formed by cutting away adjacent portions of the bottom wall 110 and end closure 118 where they intersect.

Figure 8:
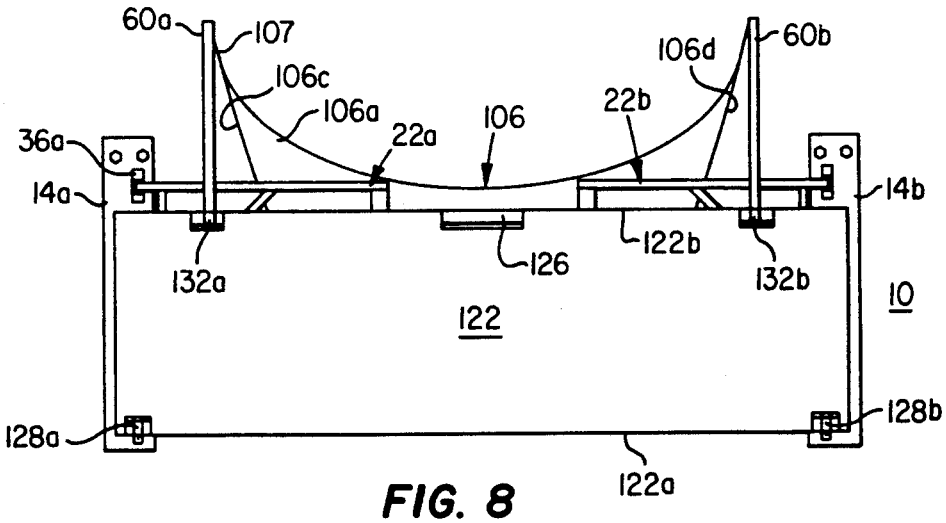
FIG. 8 is a front elevation of the training apparatus in its folded or stored condition; and, FIGS. 9, 10 and 11 diagrammatically illustrate various practice drills made possible with the depicted training apparatus.

When the apparatus is in the stored condition shown in FIG. 8, a substantial part of its frontal structure is vertically overlain by a retangular screen 122 made of a suitably strong and flexible material. The upper and lower edges 122*a* and 122*b* are folded over and stitched or otherwise formed to receive therethrough elongated tubular members or poles 124 and 126, respectively. The ends of the members 124 amd 126 generally register with the marginal sides 122*c* and 122*d* of the screen 122. When the apparatus is set up for use, the screen 122 hangs freely toward the floor surface 12 on a pair of C-shaped brackets 128*a* and 128*b* attached adjacent the bottoms of mounting bases 14*a* and 14*b* by fasteners 130. These brackets capture opposite end portions of the elongated member 124 exposed by the rectangular cut-outs 122*e* and 122*f* in the screen 122. As best illustrated in FIG. 1, a pair of J-shaped hooks 132*a* and 132*b* are attached near the vertical midpoint of the masts 60*a* and 60*b* for receiving therein short segments of elongated members 126 exposed by the cut-outs 122*g* and 122*h* in the screen 122. When the apparatus is folded, in the manner hereinafter described, the hooks 132*a* and 132*b* swing inwardly toward one another into vertical alignment with exposed segments of the elongated member 126. Member 126 may be conveniently lifted upwardly by manually grasping another segment of the same which is exposed by the central cut-out 122*i* in the scree's lower edge 122*b*.

OPERATION OF THE INVENTION

Having described the structural details of the apparatus and its method of operation, its applications in the training of volleyball players will now be disclosed.

The site of the initial installation of the apparatus may comprise any clear space on a wall in a gymnasium or other suitable building which is somewhat wider than one half the width of a regulation volleyball net and extends vertically from the floor to a height at least four or five feet above regulation net height. The floor space requirement on the player side of the net, i.e. the area extending outwardly from the wall 10 beyond the net 62, is determined by the type of practice drill to be performed and the number of players to be involved in the drill. Some general guidelines regarding the space needs for various drills and player combinations can be gained from the diagrams in FIGS. 9, 10 and 11 where the constant dimension W is about 16 feet and the dimensions A, B and C are about 10 feet, 15 feet and 18 feet, respectively. The different drills depicted in FIGS. 9, 10 and 11 will be described more completely hereinafter.

From the above general description of the size and shape of the wall space and floor area required for using the training apparatus, it will be appreciated that this apparatus affords enhanced opportunities for coaching and training individuals or small groups of players anywhere in a gymnasium or other suitable area where utilization of an appropriate wall and floor space does not encroach upon space committed to other activities. It will also be appreciated that by using multiple apparatus it is possible to greatly expand th effective practice capacity of a relatively small gymnasium having limited floorarea. Likewise, the use of one or more apparatus can provide an additional practice area at any adequately sized location about the perimeter of a regulation size court.

After selecting a suitable site for installation of the apparatus, the mounting bases 14*a*, 14*b* are positioned and attached to the wall in a horizontally spaced relation to one another that permits the abbreviated net 62 to be tautly mounted between the standoff frames 22*a*, 22*b*. The bases 14*a*, 14*b* are vertically positioned above the floor 12 so that the range of vertical adjustment of the net 62, in the manner to hereinafter described, includes regulation net heights for male and female volleyball players. The mounting bases 14*a*, 14*b* could be eliminated in favor of securing the standoff frames directly to the wall 10 if so desired.

After mounting the bases 14*a*, 14*b* to the wall 10 and mounting the frames 22*a*, 22*b* upon their respective bases by means of pivot brackets like that shown at 36*a* in FIG. 4, the frames are swung to the position shown in FIGS. 1 and 2 wherein the brackets are generally perpendicular to wall 10. In this position of the frames, the previously described guys 78, 80, 82, 84, 108 and 109 can be appropriately sized for attachment to the eyebolts 90, 96, 102 and 104 set in the wall 10.

After the turnbuckles 70 and 76 are rotated to prevent tensioning of the net lines 64 and 74 and after some lengthening rotation of the turnbuckles 98 and 100, the right-hand standoff frame 22*b* is drawn in an outboard direction by the guys 82, 84 and 109 being pulled outwardly sufficiently to allow the hooked ends of the turnbuckles to be inserted into the projecting eyebolts 102 and 104. The turnbuckles 98 and 100 are then tightened so that the guys 82, 84 and 109 become taut with the frame 22*b* being held perpendicularly to the wall 10. The hooks 88 and 94 are attached to their respective eyebolts; and, the desired tension in the net lines 64 and 74 may be set by operating the turnbuckels 70 and 76. As previously indicated, the adjustable tensions in the guys 82, 84 and 109 and in the net lines 64 and 76 counteract in a fashion that stabilizes the standoff frame 22*b* in its desired perpendicular relationship to wall 10 and in parallel relationship with the other standoff frame 22*a*.

An important aspect of this apparatus resides in the means by which the net height above the floor may be easily and conveniently adjusted. To this end, the net 62 and the means for mounting the same are carried entirely by the aforementioned tubular elements 48*a* and 48*b* which are adapted for telescopic movement about and along the frame members 30*a* and 30*b*. Loosening the knobs 50 releases the tubular elements 48*a*, 48*b* whereby the net height is infinitely variable between extreme upper and lower positions determined by abuttment of the tubular elements with horizontal frame members 26*a*, 26*b*, 28*a* and 28*b*. The net is locked at a selected height by tightening the knobs 50. Index markings may be placed on the vertical members 30*a* and 30*b* to indicate conveniently the height of the net above the floor and to assure that both ends of the net are the same distance above the floor 12.

With the apparatus set up in the manner just described, the tops of the masts 60*a*, 60*b* are supported by guys 108 and 109; and, theline 107 from which the ball barrier 106 hangs is stretched between the masts as shown in FIG. 1. The upper edge of the front wall 106*b* of the ball barrier 106 registers with and is supported along the top 62*a* of the net 62 by the line 64. The body of the barrier including the flattened and reinforced bottom 110 hangs down behind the net and a basket 134 may be placed thereunder to receive practice balls, shown in phantom lines, dropping through the opening in the barrier bottom.

At all times the apparatus is being used in practice, the protective screen 122 hangs freely on the brackets 128*a* and 128*b*. The dimension of the screen along edges 122*c*, 122*d* may be made longer or shorter than that shown in FIGS. 1 and 2; however, the disclosed screen is appropriately sized to cover that portion of the apparatus easily reached by a person standing on the floor, yet it remains out of contact with the floor 12.

When the apparatus is employed in practice, it is intended that a ball driven over the top of net 62 will strike the back wall 106*a* of the ball barrier 106. The impact force of the ball will be substantially, if not totally, absorbed as this flexible wall is deflected and distorted; and, the ball will then drop toward the bottom wall 110 of the ball barrier. The composition of the barrier should be selected to enhance such a no-rebound effect. The purpose of the side closure walls 116 and 118 is to block the escape from the barrier of any ball that rebounds or spins sideways after striking the back wall 106*a*. It will be appreciated that the front, back, bottom and side closures of the ball barrier together form a basket-like enclosure for receiving and returning balls struck over the net. The bottom 10 of this enclosure is troughlike and is flattened by the stiffener 112 to facilitate free rolling of a ball therealong from the elevated left-hand end of the trough to the ball opening at the lower right-hand end of the trough. The ball is then self-ejected from the opening to be caught by hand or to fall into the storage container 134.

Preparatory to drawing the protective screen upwardly over the front of the apparatus, as shown in FIG. 8, the turnbuckles 98 and 100 are lengthened sufficiently to permit manual removal of these turnbuckles from the eyebolts 102 and 104. This removes tension from the guys 82, 84 and 109 whereby the standoff frame 22*b* may pivot toward standoff frame 22*a* to release tension in the net lines 64 and 74 and tension in the guys 78, 80 and 108. The hooks 88 and 94 are then disengaged to permit pivoting of the standoff frame 22*a*. As the frames 22*a*, 22*b* are pivoted inwardly toward one another, the ball barrier line 107 and the net line 64 will drop downwardly permitting the ball barrier 106 and the net 62 to sag toward the floor. When the frames 22*a*, 22*b* have been pivoted inwardly into pressing contact with the sagging net, the folded apparatus will project but a short distance from the face of wall 10. In this compact condition, the front of the apparatus is then covered by the screen 122 and the collapsed net and ball barrier are supported by and enclosed within the screen as the latter is drawn upwardly in response to placing the ends of the elongated pole 126 in the J-shaped hooks 132*a*, 132*b*.

The foldable storage feature of this invention coupled with the use of the protective screen affords these advantages among others:

1. When not in use, the apparatus may be stored in place;
2. The encroachment of the stored apparatus upon floor space needed for other activities is minimal;
3. The screen provides a smooth covering over the rigid frames 22*a*, 22*b* which provides a degree of protection to anyone who might accidently fall against the stored apparatus;
4. The screen discourages tampering with the stored apparatus which could damage the apparatus or lead to injury of the tamperer; and,
5. The screen gives the stored apparatus a neat, nonobtrusive appearance.

Figure 9:
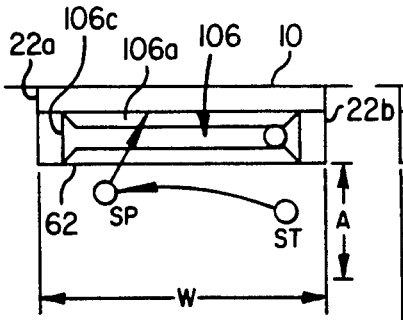
Figure 10:
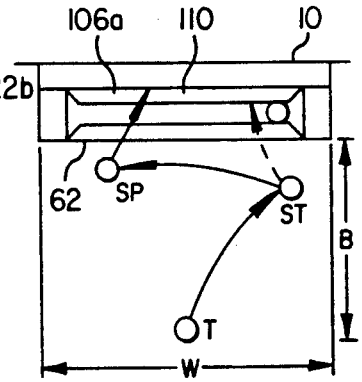
Figure 11:
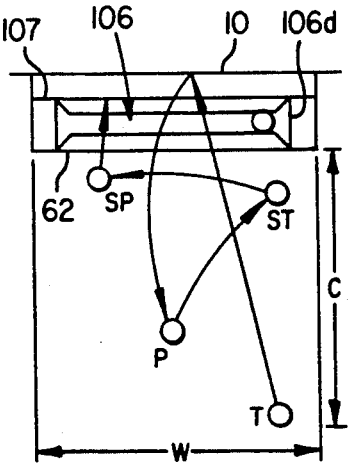

The ability of a wall-mounted training device constructed according to this invention to afford trainees and coaches a variety of realistic ball-striking exercises within very limited confines can be appreciated by considering the play diagrams shown in FIGS. 9, 10 and 11.

In the FIG. 9 exercise, a setter ST, who may be a coach or another player, passes or tosses the ball to a spiker SP who attempts to drive the ball over the net against the rear wall 106a of the ball barrier. The ball may be passed to the spiker in any number of realistic ways so that skills gained through this type of drill will be carried over into actual game situations. A ball driven into the basket-like barrier 106 will drop through the bottom opening into the ball container 134 whereby troublesome scattering of practice balls and interruptions of the drill are completely obviated.

FIG. 10 depicts a three-person exercise involving a coach or other tosser T, a setter ST and a spiker SP. The ball is first tossed to the setter who may either drive the ball over the net (broken line) or set the ball for the spikeras in the exercise shown in FIG. 9.

In FIG. 11, a tosser T throws a ball so that the ball clears the net 62 and the ball barrier 106 and thereafter strikes the wall 10 and rebounds into the playing area in the vicinity of the passer P. The passer passes the ball to the setter ST who in turn sets the ball for the spiker SP. In this exercise three of the main ball-striking tasks in the game of volleyball may be practiced in a repetitive manner. Serving may be practiced by striking the ball from the serving line into the ball barrier. It will be appreciated that a great many other training exercises and drills beyond those examples just given may be devised by coaches and teachers who utilize this invention.

The foregoing description of the invention shown in the drawings is illustrative and explanatory only; therefore, various changes in the size, shape and materials of the described construction as well as changes in specific details of its operation and usage may be made without departing from the scope of the invention. Moreover, I do not intend to be limited to the details shown and described herein, but intend to cover all changes and modifications which are encompassed by the scope and spirit of the appended claims.

What I claim for my invention is:

1. A surface-mountable volleyball training apparatus, comprising:

a pair of vertically extending rigid frames disposed in horizontally spaced relation to one another which are attached to an upright surface and project outwardly from said surface;

said frames being pivotably attached to said surface for swinging movement relative to said surface and to one another; and, a net supported between said frames in spaced relation to said surface.

2. The apparatus set forth in claim 1, together with stabilizing means attached to said frames to secure the same from swinging movement.

3. The apparatus set forth in claim 2, wherein:

said stabilizing means comprise guys releasably connecting said frames to said surface.

4. The apparatus set forth in claim 2, wherein:

said frames are secured in generally perpendicular relation to said surface.

5. The apparatus set forth in claim 1, wherein:

said frames swing toward one another and toward said surface to a folded position; and, a flexible screen is attached to said surface adjacent said apparatus and is movable relative to said frames to cover said net and at least a substantial portion of said frames when said frames are folded.

6. The apparatus set forth in claim 1, together with a ball barrier supported by said frame rearwardly of said net.

7. The apparatus set forth in claim 1, wherein:

said frames includes vertically movable members and means for arresting such vertical movement relative to said frames; and said net is attached between said members for vertical movement therewith.

8. A mountable volleyball training apparatus, comprising:

a pair of rigid frames mounted on upright surfaces and projecting outwardly from said surfaces;

a net supported between said frames in spaced relation to said surfaces;

said net having a side-to-side dimension that is about one-half that of a regulation volleyball net; and a ball barrier supported rearwardly of said net.

9. The apparatus set forth in claim 8 (amended), wherein:

said net is supported by a line having one end attached to one of said frames and another end attached to a tensioning device carried by the other of said frames.

10. The apparatus as set forth in claim 8 (amended), wherein:

said net is supported by a line having said one end attached to a vertically movable member of said one of said frames and said tensioning device being attached to a vertically movable member of said other of said frames.

11. A surface mounted volleyball training apparatus, comprising:

a pair of rigid frames attached to an upright surface and projecting outwardly from said surface;

a net supported between said frames in spaced relation to said surface;

said frames including mast members extending upwardly from said frames above the net;

said mast members being connected by a line; and, a ball barrier is connected between said line and said net.

12. The apparatus set forth in claim 11, wherein:

said ball barrier has a front edge attached to said net, a rear edge attached to said line, and a body portion intermediate said edges suspended between the net and said surface.

13. The apparatus set forth in claim 12, wherein:

said body portion has a sloping bottom.

14. The apparatus set forth in claim 12, wherein:

said body portion is provided with side closure walls.

15. The apparatus set forth in claim 13, wherein:

said sloping bottom is reinforced by a stiffening member.

16. The apparatus set forth in claim 14, wherein:

said sloping bottom portion has an opening therethrough and said stiffener has a width generally corresponding to the diameter of a volleyball.

17. A mountable volleyball training apparatus comprising:

rigid frames attached to horizontally spaced upright mounting means and projecting outwardly therefrom;

a volleyball net and a flexible ball barrier supported between said frames outwardly of said mounting means.

18. The apparatus set forth in claim 17, wherein:

said barrier has a marginal edge attached to said net.

19. A volleyball training apparatus, including:

a net over which a ball is struck;

a flexible barrier for intercepting a ball struck over said net; and said barrier having an edge attached to an edge of said net.

* * * * *